US005326340A

United States Patent [19]

Coffey

[11] Patent Number: 5,326,340

[45] Date of Patent: Jul. 5, 1994

[54] EXERCISE DEVICE

[75] Inventor: Michael J. Coffey, 120-12 85th Ave., Jamaica, N.Y. 11415

[73] Assignee: Michael J. Coffey, Jamaica, N.Y.

[21] Appl. No.: 99,173

[22] Filed: Jul. 29, 1993

[51] Int. Cl.[5] ..... A63B 21/06

[52] U.S. Cl. ..... 482/93; 482/108; 482/139; 273/81.4

[58] Field of Search ..... 482/49, 80, 93, 106, 482/108, 139, 102, 103, 107, 109, 110, 148; 273/81.4

[56] References Cited

U.S. PATENT DOCUMENTS

| | | | |
|---|---|---|---|
| D. 197,899 | 4/1964 | Sotcliffe | 482/50 X |
| 1,229,658 | 6/1917 | Sandow | 482/50 |
| 1,672,944 | 6/1928 | Jowett | 482/108 |
| 3,129,939 | 4/1964 | Stock | 482/49 |
| 3,410,017 | 11/1968 | Wilson | 273/81.4 X |
| 3,756,594 | 9/1973 | Goodwin | 482/49 |
| 3,825,253 | 7/1974 | Speyer | 482/106 |
| 4,218,057 | 8/1980 | Wilson | 482/93 |
| 4,351,526 | 9/1982 | Schwartz | 482/105 X |
| 4,678,181 | 7/1987 | Ditsch et al. . | |
| 4,691,915 | 9/1987 | Sutton | 482/50 |
| 4,754,963 | 7/1988 | Dowd . | |
| 4,785,495 | 11/1988 | Dellis | 273/81.4 X |
| 4,898,380 | 2/1990 | Kobrin | 482/93 |
| 4,934,024 | 6/1990 | Sexton, I | 273/81.4 X |
| 5,076,569 | 12/1991 | Gootter | 482/49 |

FOREIGN PATENT DOCUMENTS

| | | | |
|---|---|---|---|
| 380231 | 9/1923 | Fed. Rep. of Germany | 482/50 |
| 1112170 | 11/1955 | France | 482/49 |
| 21603 | 11/1901 | United Kingdom | 482/49 |

OTHER PUBLICATIONS

Article "Elliptical Dumbbells-Custom Made for the Human Hand," Aug. 1989.

*Primary Examiner*—Robert Bahr

[57] ABSTRACT

An identity grip device conforms to the shape of a human hand which will grip the device. There is a first end portion, a second end portion and a central portion which continuously connects the first end portion to the second end portion. The central portion has a top side and a bottom side and finger grips located on the top side of the central portion. Thumb grips are located on the bottom side of the central portion. The identity grip device may be used with an exercise device such as a dumbbell.

7 Claims, 3 Drawing Sheets

FIG. 1
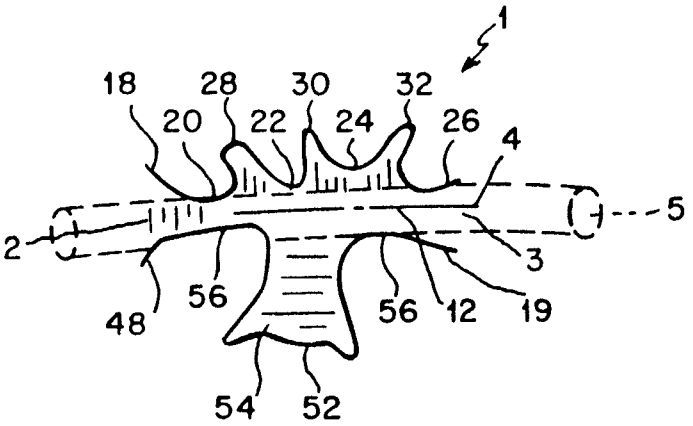
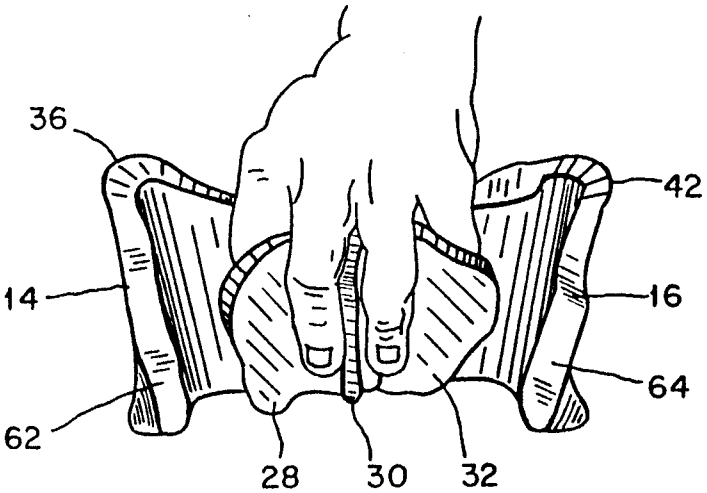
FIG. 3
FIG. 2
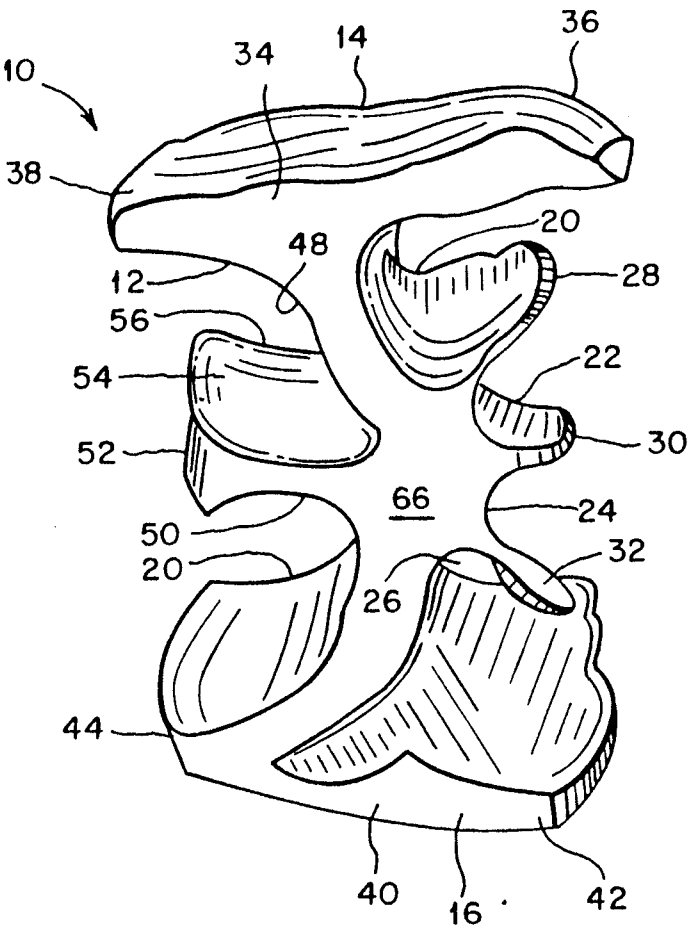

EXERCISE DEVICE

BACKGROUND OF THE INVENTION

1. Field of the Invention

The present invention relates to a unique hand grip that can be used with an exercise device comprising a dumbbell molded to conform to the shape of the individual human hand which will grip the device.

2. The Prior Art

Dumbbells are well known as exercise devices, and in the prior art consist of a short straight bar with a weight at each end thereof. This short straight bar is of linear shape and is to be used as the gripping means during exercise. However, the shape of the normal human hand which will grip the dumbbell is non-linear during exercise. Therefore, discomfort and muscle strain can readily develop within the hand and forearm of the person using the prior art dumbbell during exercise. The pressure generated from the pinky side end of the palm to the thumb side end of the palm is intense when grasping a linear straight bar.

Prior art exercise devices are described in the following prior art references.

The Ditsch et al. U.S. Pat. No. 4,678,181 discloses a hand development system, comprising: a body adapted to be gripped by the hand of a user, this body including a single interior compartment and a plurality of openings in communication with the single interior compartment. The openings are provided along a top edge of the body. The fingers of the user are exercised by exercising means operatively associated with the body and including a plurality of individually movable members each adapted to be moved by one of the fingers. The exercising means also includes means for resisting movement of the individually movable members. Each of the individual movable members comprises a key adapted to be depressed from a normal position by one of the fingers of the user. The body is generally rectangular in shape and the openings are disposed in longitudinally aligned relationship. The movement resisting means includes a set of spring-loaded cartridges disposed in the single interior compartment. Each of the cartridges includes at least one spring having a selected resistance to depression of the keys. The cartridges are also generally rectangular in shape and are sized for sliding insertion into the interior compartment. Each of the cartridges is accurately positioned within the single interior compartment for resisting movement of one of the keys.

The Dowd U.S. Pat. No. 4,754,063 discloses a hand exercising device of the type including a resilient body of a size and shape to fit within the palm area of a user's hand, said body being formed of a homogenous and readily compressible material. The body includes recess means formed therein to alter the compressibility of the body. The resilient body is formed in the shape of a truncated cylinder wherein the cylinder height is less than its diameter. The recess means includes a plurality of circular openings extending through the body and terminating in each planar face thereof. A ball member is removably insertable within each opening to alter the compressibility of the device. Each opening includes a spherical pocket for resiliently retaining the ball and the diameter of the ball is greater than the height of the resilient body whereby the ball partially projects beyond each planar face of said body.

SUMMARY OF THE INVENTION

It is an object of the present invention to overcome this prior art problem of muscle strain and discomfort during exercising with dumbbells.

It is another object of the present invention to provide a unique hand grip that can be used with an exercise device comprising a dumbbell molded to conform to the shape of the individual human hand which will grip the device.

The identity grip has the advantages of unique hand grip, anatomical design, and less hand stress during exercise, because the thumb to middle finger clench exerts even pressure throughout the hand, unlike bars, which stress the thumb and pinky sides of the palm. The grip feels natural in the hand, increasing hand control. It develops thumb and finger grip strength, allows full extension with more confidence, and creates better muscle isolation. Each grip is ambidextrous, being individually formed to fit both hands of the user.

The identity grip can be formed with a hollow, cylindrical center so as to be employed in exercise equipment as grips for dumbbells, barbells, or equipment used in physical therapy. The identity weight is an example of one use of the identity grip. Identity weights are an improvement over the prior art of dumbbells, incorporating all the benefits of the identity grip and eliminating the risks associated with one solid weight that can be turned and extended with the clang and danger of loose weights at the ends of the bar.

Identity grips can be formed of many materials, including metal, wood, plastic, rubber, etc. Any material that can be molded to the hand in the manner prescribed can be used to form identity weights.

Identity weights according to the invention are dumbbell exercise equipment of a higher order. Classically, dumbbells consist of no more than a linear short metal bar and weights at either end. There is thus an impersonal meeting between the non-linear shape of the hand and the linear shape of a straight steel bar.

Dumbbell design contour weights according to the invention can be prepared in various patterns and sizes for each pattern. The dumbbell device of the invention can be made by metal casting in order to be gripped by both left-handed and right-handed persons. The pressure received from the pinky side to the thumb side on the ends of the palm is intense when grasping a prior art straight metal bar. Dumbbell design weights according to the invention are made to evenly distribute the gripping pressure across the entire palm of the hand.

The dumbbell design of the invention is a natural grip aligning the middle finger and thumb, incorporating and increasing both finger strength and grip strength. Individual, personal hand identification is furthered by a left leather grip and right leather grip. This leather grip is soaked and stretched over the steel cast grip. After the leather has dried, another leather can be stretched, dried, and glued together, increasing grip size. Once the size is satisfactory, the dumbbell identity grips can be further sculpted by performing surface contouring with different size leather cutouts and gluing them to the primary leather grip, taking on a topographical mapping. The result will both increase the size of the grip and create the recessive and enunciated variations of the individual hand print.

Identity weights such as the dumbbells according to the present invention are exercise equipment that is familiar to touch, making the relationship between hand and metal such as steel more intimate. The terminology "identity weights" and "design weights" means that the dumbbell is produced so as to have a weight and shape that is so compatible with the hand of the person using the dumbbell that this exercise device becomes like an extension of the user's body. The amount of time using design weights can be lengthened because the user has a comfortable grip.

Correct use, with slow deliberate full range of motion exercises, verifies that the weight itself becomes an extension of the user's body. Any grip that does not replicate this design grip will be alien and unnatural.

BRIEF DESCRIPTION OF THE DRAWINGS

Other objects and features of the present invention will become apparent from the following detailed description considered in connection with the accompanying drawings which disclose two embodiments of the present invention. It should be understood, however, that the drawings are designed for the purpose of illustration only and not as a definition of the limits of the invention.

In the drawings, wherein similar reference characters denote similar elements throughout the several views:

FIG. 1 is a front view of a first embodiment of the identity grip device of the present invention;

FIG. 2 is a perspective view of the exercise device of the present invention incorporating the identity grip of FIG. 1;

FIG. 3 is a top view of the exercise device of FIG. 2 rotated through 90° and shown being gripped by the hand of a person;

DETAILED DESCRIPTION OF PREFERRED EMBODIMENTS

Figure 4:
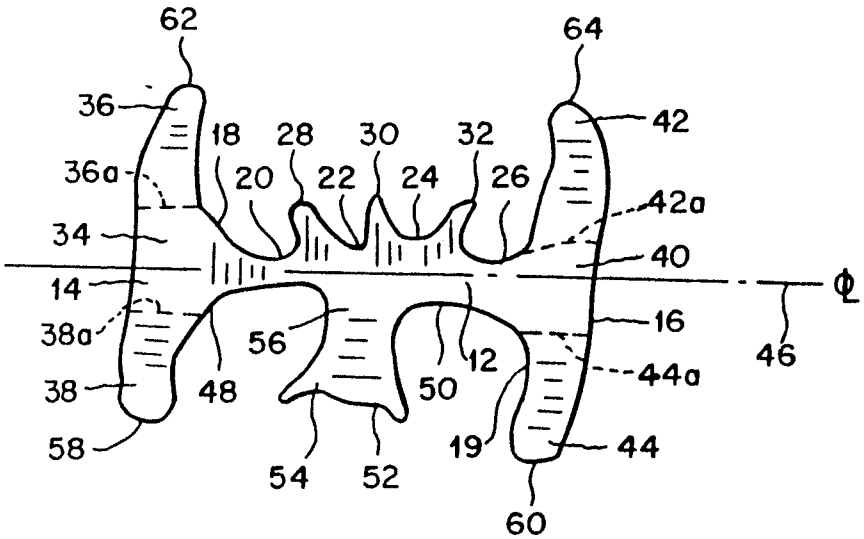
FIG. 4 is a front view of the exercise device of FIG. 2 rotated through 90°.

Turning now in detail to the drawings, FIG. 1 shows a front view of the identity grip device 1 of the invention. Identity grip 1 is an individual holding means having a central non-linear portion 12 with a first end portion 2 continuously attached thereto at one side end and a second end portion 3 continuously attached to the opposite side end. Central portion 12 has a top side 18 and a bottom side 19, as shown in FIGS. 1 and 4. Central portion 12 can be solid. In an alternative embodiment, central portion 12 can be hollow as indicated by the dotted lines 4. If the grip is hollow, it can fit over a straight line bar 5 to convert bar 5 into an identity grip bar.

FIG. 2 shows a perspective view of the exercise device 10 of the invention. Device 10 is a dumbbell incorporating the identity grip device 1 of FIG. 1 and having a central non-linear portion 12 with a first end portion 14 continuously attached thereto at one side end and a second end portion 16 continuously attached to the opposite side end. Central portion 12 has a top side 18 and a bottom side 19, as shown in FIG. 4.

As shown in FIGS. 1 and 4, top side 18 has four receptacle depression finger grip means 20, 22, 24, and 26 into which a different finger of either the right hand or the left hand is positioned when the person using the dumbbell grips the exercise device. Receptacle depressions 20 and 22 are separated by projection 28. Receptacle depressions 22 and 24 are separated by projection 30. Receptacle depressions 24 and 26 are separated by projection 32. The first end portion 14 includes a middle section 34 continuously connected to an upper arm 36 via dotted line **36*a* and to a lower arm 38 via dotted line 38*a*. Second end portion 16 includes a middle section 40 continuously connected to an upper arm 42 via dotted line 42*a* and to a lower arm 44 via dotted line 44*a*. Upper arms 36 and 42 extend to a farther distance above centerline 46 than projections 28, 30 and 32 extend above center line 46**.

As shown in FIGS. 1 and 4, bottom side 19 has two cavities 48 and 50 which are thumb grip means separated by wall means 52. The thumb of the person using the exercising device would be placed within one of these two cavities 48 or 50, with the thumb of the left hand being placed within cavity 48, and with the thumb of the right hand being placed within cavity 50. Wall means 52 has a wide base 54 with a narrow neck 56 relative to the base 54. Neck 56 connects the wall means 52 to the bottom side 19 of the central portion 12. Lower arms 38 and 44 extend to a farther distance below the centerline 56 than wall means 52 extends below centerline 46.

Figure 5:
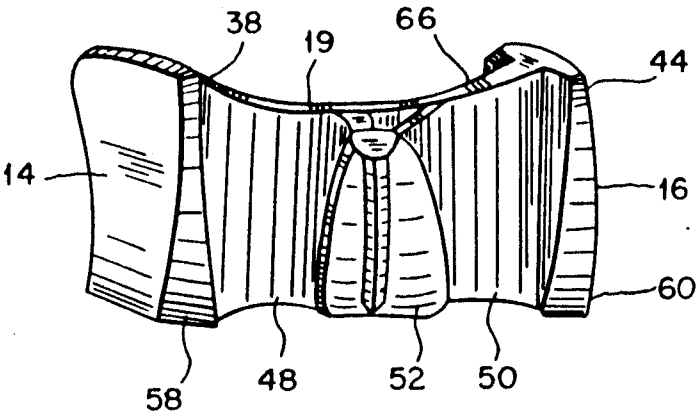
FIG. 5 is bottom view of the exercise device of FIG. 3.

FIG. 5 shows a bottom view of the exercise device of FIG. 4 showing the wall means 52 positioned in the mid-portion of the bottom side 19 between cavities 48 and 50. It can be seen that lower arm 38 has a flat end wall 58 and that lower arm 44 has a flat end wall 60.

FIG. 3 shows a top view of the exercise device in which the upper arm 36 has a flat end wall 62 and in which the upper arm 42 has a flat end wall 64. FIG. 3 also shows the placement of the four fingers of a hand which is gripping the exercise device. These four fingers are separated by the three projections 28, 30 and 32.

Figure 6:
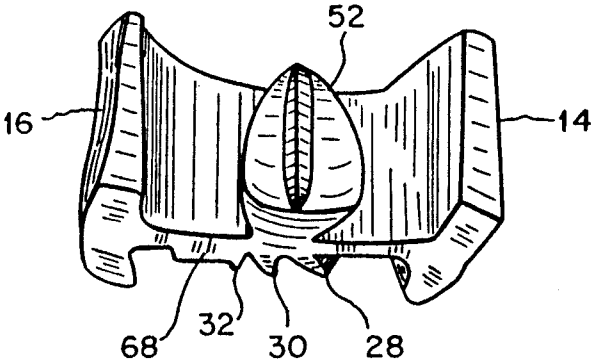
FIG. 6 is a perspective bottom view of the exercise device of FIG. 4.

FIG. 5 shows that side surface 66, which is also illustrated in FIG. 2, is a flat surface. FIG. 6 shows that side surface 68 is also a flat surface.

Because the weight of the dumbbell in the central portion thereof is equal approximately to the weight situated in one end portion, the overall weight of the exercise device is fairly evenly distributed across the hand which would grip the dumbbell making for a very comfortable stress-free grasping thereof. In other words, the weight in each end portion is equal to the weight in the other end portion and is equal to the weight in the central portion of the dumbbell. The dumbbell can be specifically designed for the hand of the user, and is individually produced as a metal casting, usually made of brass cast into a sand mold.

Figure 8:
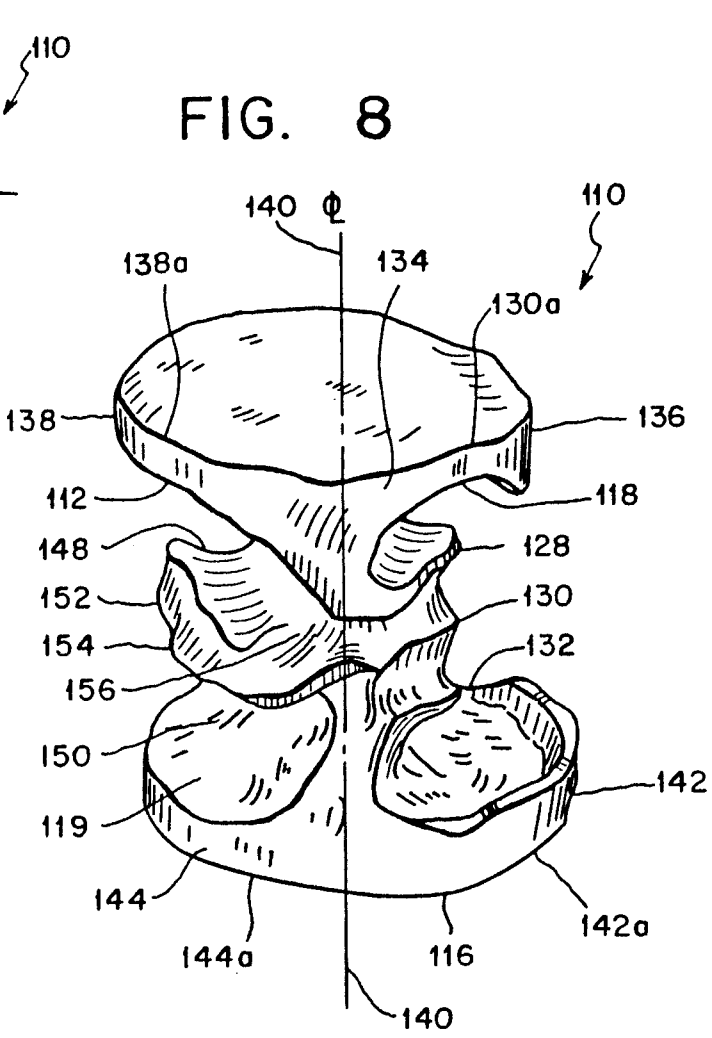
FIG. 8 is a perspective view of the exercise device of the present invention incorporating the identity grip of FIG. 7.
Figure 7:
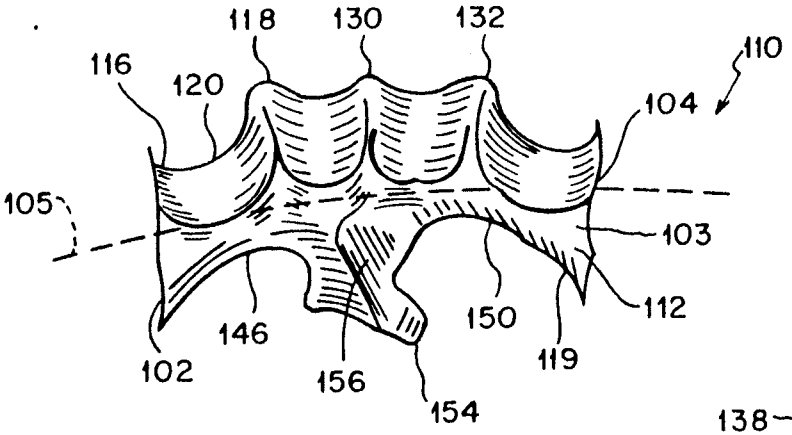
FIG. 7 is a front view of a second embodiment of the identity grip device of the present invention.
Figure 9:
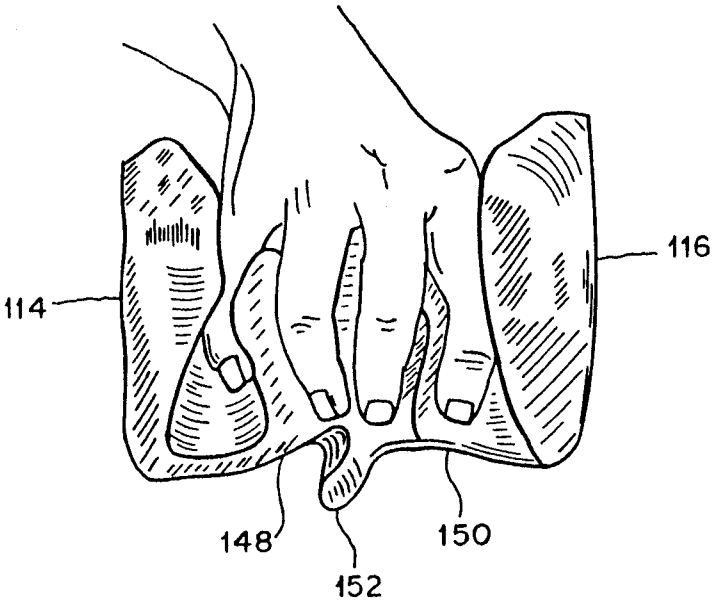
FIG. 9 is a top view of the exercise device of FIG. rotated through 90° and shown being gripped by the hand of a person.

FIGS. 7 to 9 illustrate a second embodiment of the invention. FIG. 7 shows a front view of the identity grip device 100 of the invention. Identity grip 100 is an individual holding means having a central non-linear portion 112 with a first end portion 102 continuously attached thereto at one side end and a second end portion 103 continuously attached to the opposite side end. Central portion 112 has a top side 118 and a bottom side 119. Central portion 112 can be solid. In an alternative embodiment, central portion 112 can be hollow as indicated by the dotted lines 104. If the grip is hollow, it can fit over a straight line bar 105 to convert bar 105 into an identity grip bar.

FIG. 8 shows a perspective view of the exercise device 110 of the invention. Device 110 is a dumbbell incorporating the identity grip device 100 of FIG. 7 and having a central non-linear portion 112 with a first end portion 114 continuously attached thereto at one side end and a second end portion 116 continuously attached to the opposite side end. Central portion 112 has a top side 118 and a bottom side 119.

As shown in FIGS. 7 and 8, top side 118 has four receptacle depression finger grip means 120, 122, 124, and 126 into which a different finger of either the right hand or the left hand is positioned when the person using the dumbbell grips the exercise device. Receptacle depressions 120 and 122 are separated by projection 128. Receptacle depressions 122 and 124 are separated by projection 130. Receptacle depressions 124 and 126 are separated by projection 132. The first end portion 114 includes a middle section 134 continuously connected to an upper arm 136 via dotted line **136*a* and to a lower arm 138 via dotted line 138*a*. Second end portion 116 includes a middle section 140 continuously connected to an upper arm 142 via dotted line 142*a* and to a lower arm 144 via dotted line 144*a*. Upper arms 136 and 142 extend to a farther distance above centerline 146 than projections 128, 130 and 132 extend above centerline 146**.

As shown in FIGS. 7 and 8, bottom side 119 has two cavities 148 and 150 which are thumb grip means separated by wall means 152. The thumb of the person using the exercising device would be placed within one of these two cavities 148 or 150, with the thumb of the left hand being placed within cavity 148, and with the thumb of the right hand being placed within cavity 150. Wall means 152 has a narrow base 154 with a wide neck 156 relative to the base 154. Neck 156 connects the wall means 152 to the bottom side 119 of the central portion 112. Lower arms 138 and 144 extend to a farther distance below the centerline 156 than wall means. 152 extends below centerline 146.

While only two embodiments of the present invention have been shown and described, it is to be understood that many changes and modifications may be made thereunto without departing from the spirit and scope of the invention as defined in the appended claims.

What is claimed is:

1. An ambidextrous grip device contoured to the shape of a human hand, comprising:

a central portion having a first and second end, a first and second side, and a top and bottom surface, the distance between the first and second sides being greater than the width of the central portion;

three projections extending from the top side of the central portion, the three projections and the first and second ends of the central portion defining four receptacle depressions, the receptacle depressions between the three projections having less depth than the receptacle depressions between the first and second ends of the central portion and the projections; and, a wall member extending from the bottom side of the central portion, the wall member having an intermediate portion and terminating at an end portion, the end portion of the wall member having a greater width than the intermediate portion of the wall member.

2. The ambidextrous grip device of claim 1, wherein the central portion is solid.

3. The ambidextrous grip device of claim 1, wherein the central portion is hollow.

4. The ambidextrous grip device of claim 1, wherein the central portion includes a centerline and the end portions of the central portion are weight members which extend a distance from the centerline greater than does the wall member.

5. The ambidextrous grip device of claim 1, wherein the central portion includes a centerline and the end portions of the central portion are weight members which extend a distance from the centerline greater than do the projections.

6. The ambidextrous grip device of claim 1, wherein the device is formed of a metal casting.

7. The ambidextrous grip device of claim 6, wherein the metal is brass.

* * * * *